US005975887A

United States Patent [19]

Kamal et al.

[11] Patent Number: 5,975,887

[45] Date of Patent: Nov. 2, 1999

[54] COMPACT HI-SPIN GAS BURNER ASSEMBLY

[75] Inventors: Azfar Kamal, Arkanasas City; Danny Linn Christenson, Mulvane, both of Kans.

[73] Assignee: Gordon-Piatt Energy Group, Inc., Winfield, Kans.

[21] Appl. No.: 09/012,536

[22] Filed: Jan. 23, 1998

Related U.S. Application Data

[60] Provisional application No. 60/036,272, Jan. 24, 1997.

[51] Int. Cl.[6] ..... F23C 5/08

[52] U.S. Cl. ..... 431/181; 431/10; 431/187; 431/350; 431/354

[58] Field of Search ..... 431/181, 185, 431/186, 187, 188, 159, 171, 350, 354, 9, 10, 347, 182, 183, 184

[56] References Cited

U.S. PATENT DOCUMENTS

| | | | |
|---|---|---|---|
| 3,947,230 | 3/1976 | Zetterstrom et al. | 431/171 |
| 4,383,820 | 5/1983 | Camacho | 431/187 |
| 4,919,120 | 4/1990 | Horikoshi et al. . | |
| 5,415,539 | 5/1995 | Musil | 431/181 |
| 5,437,123 | 8/1995 | Greiner et al. | 431/171 |
| 5,486,108 | 1/1996 | Kubota . | |
| 5,494,437 | 2/1996 | Kubota et al. . | |

FOREIGN PATENT DOCUMENTS 92 08 993 U 10/1992 Germany .

*Primary Examiner*—Ira S. Lazarus
*Assistant Examiner*—Josiah Cocks
*Attorney, Agent, or Firm*—Crowe & Dunlevy

[57] ABSTRACT

A burner apparatus having a burner tube in which is disposed a premixing tube having air communication with the air inlet end of the burner tube. An air diffuser bridges between the premixing tube and the burner tube. A baffle plate is supported by and seals across one end of the premixing tube and a plurality of gas/air mixture injection holes are dispersed in the premixing tube between the air diffuser plate and the baffle plate. A gas tube extends into the premixing tube and a plurality of gas holes are disposed along the gas tube in proximity to the discharge end of the gas tube so that air is premixed with gas and discharged from the gas holes to form a gas/air mixture which is passed from the gas/air mixture injection holes radially between the baffle plate and an air diffuser plate.

23 Claims, 7 Drawing Sheets

COMPACT HI-SPIN GAS BURNER ASSEMBLY

RELATED APPLICATION

This application claims the benefit of U.S. Provisional patent application Ser. No. 60/036,272 entitled COMPACT HI-SPIN GAS BURNER, filed Jan. 24, 1997, which is hereby incorporated by reference.

BACKGROUND OF THE INVENTION

1. Field of Invention

The present invention relates to the field of fuel gas combustion, and more particularly but not by way of limitation, to an improved compact hi-spin gas burner which is inexpensive to construct, efficient to operate, modular in construction and effective in performance while yielding favorable emission ratings, and which achieves unrestricted spatial orientation.

2. Discussion

Power burners, those that utilize a prime mover to force all the combustion air into the combustion zone, are divided into two main classes: diffusion burners and premixed burners. Diffusion burners keep the air and fuel separate until the point of ignition. Under these conditions, the rate of reaction is faster than the rate of diffusion because the physical mixing of the reactants, the fuel and the air, is slower than the chemical rate of reaction. These factors, that is, the relatively slow rate of combustion and the maintained separation of the reactants until reaching the point of ignition, significantly reduce the dangers of flash back within the burner. However, the flames in diffusion burners are heterogeneous with respect to the reactants, to the products of combustion, and to the temperature gradients, thereby resulting in a long and yellowish flame that can comprise of large amounts of NOx.

Premixed burners produce homogeneous flames, i.e., uniform in temperature and products of combustion, because the uniform premixing of the fuel and gas before the point of ignition increases the reaction rate and creates a short and relatively blue flame. The uniformity in temperature creates a flame that has reduced NOx emissions. However, the presence of a combustible mixture throughout the burner tube can result in an increased chance of flashback whereby the flame travels back in the mixture tube, possibly resulting in an explosion or extreme damage to the burner equipment.

With regard to NOx emissions, the United States Environmental Protection Agency (EPA) was established to regulate air quality at a national level. At the EPA's recommendation, Congress passed the Clean Air Act Amendments to identify the processes producing pollutants and to impose pollutant emission limits on the States in an effort to establish air quality standards.

The Combustion industry was made a regulatory target for mandated control of nitrogen oxide and carbon monoxide emissions. Combustion of fossil fuels generates air pollutants including oxides of both carbon and nitrogen. In particular, boilers and steam generators, commonly used in industrial and commercial applications, burn fuel with air to produce heat, and thus also produce significant amounts of pollutants, including oxides of carbon and nitrogen. Oxides of nitrogen, collectively known as NOx, are major air-borne pollutants that can potentially cause acid rain, ozone destruction, global warming, smog formation, and vegetation destruction. Emission of carbon monoxide, CO, is not only harmful to the environment, but also is an indicator of low combustion efficiency, as CO is the product of partial combustion.

In anticipation of regulatory control, a continuing trend in the combustion industry has been the development of boilers that produce lower NOx and CO emissions, and this at ever decreasing costs. To this end, improvements are continually being made to improve the efficiency of combustion in boilers while reducing deleterious emissions.

The prior art includes a variety of approaches to minimizing NOx emission rates, including both external and internal flue gas recirculation (FGR); steam injection (SI); fuel and air staging; premixing; controlled excess air firing; ceramic fiber; selective catalytic and non-catalytic reduction (SCR and SNCR); low NOx oil (for oil burning); and methods to introduce instabilities in the flow field, including the use of elliptical geometries, resonant generators, etc. However, these methods vary in cost as well as effectiveness in the reduction of NOx, and expensive components are necessary for implementing these methods. Further, as most power burners are designed for a particular type of boiler, water heater, or steam generator, each such prior art method of reducing NOx is generally application specific, limiting the usefulness of the prior art burners.

Accordingly, there is a continued need for burners that produce homogeneous flames with reduced NOx while avoiding the dangers of flashback. Also, it is desirable that such burners achieve increased efficiency of combustion and versatility of application, and that such burners be capable of being produced economically.

SUMMARY OF THE INVENTION

The present application provides a reduced NOx burner assembly for reducing the emission of NOx while maintaining combustion efficiency and burner versatility.

In accordance with the preferred embodiment, the reduced NOx burner assembly includes a burner tube having an air inlet end and a gas/air outlet end. A premixing tube is disposed within the burner tube with one end in fluid communication with the burner tube and a distal end extending from the gas/air outlet end. An apertured air diffuser plate bridges the premixing tube and the burner tube near the gas/air outlet end while a baffle plate seals across the distal end of the premixing tube.

The premixing tube has a plurality of gas/air mixture injection holes disposed between the air diffuser plate and the baffle plate. A gas tube having a gas inlet end and a discharge end extends into the premixing tube. A plurality of gas holes are disposed along the gas tube at the discharge end to pass fuel gas to the proximity tube. Air entering the air inlet end of the burner tube is premixed with fuel gas and discharged from the gas holes at the discharge end of the gas tube to form a gas/air mixture which discharges from the gas/air mixture injection holes radially between the baffle plate and the air diffuser plate.

An object of the present invention is to provide a compact gas burner having a reduced extension from a supporting boiler front plate while having superior combustion characteristics.

Another object of the present invention, while achieving the above stated object, is to provide a compact gas burner having high spin gas/air distribution with superior pollution characteristics while being economical to construct and efficient to operate.

Yet another object of the present invention, while achieving the above stated objects, is to provide a compact gas burner characterized as producing cleaner combustion with reduced NOx and substantially minimal to no CO emission.

Another object of the present invention, while achieving the above stated objects, is to provide a compact gas burner adaptable to a wide variety of boilers, steam generators and water heaters while being economical to construct and efficient to operate.

A further object of the present invention, while achieving the above stated objects, is to provide a compact gas burner having a high spin gas/air distribution producing reduced flame length and making the burner suitable for use in short combustion chambers.

Yet another object of the present invention, while achieving the above stated objects, is to provide a compact gas burner which is versatile enough to mount horizontally, vertically or at any angle of disposition from the reference floor on a boiler or the like.

Other objects, advantages and features of the present invention will be apparent from the following description when read in conjunction with the accompanying drawings.

BRIEF DESCRIPTION OF THE DRAWINGS

FIG. 3 is a partial cutaway side view of the gas burner assembly of FIG. 1 mounted in a boiler or the like.

FIG. 9 is a semi-detailed, diagrammatical depiction of a portion of the burner housing assembly of the gas burner assembly of FIG. 1.

DESCRIPTION

Figure 1:
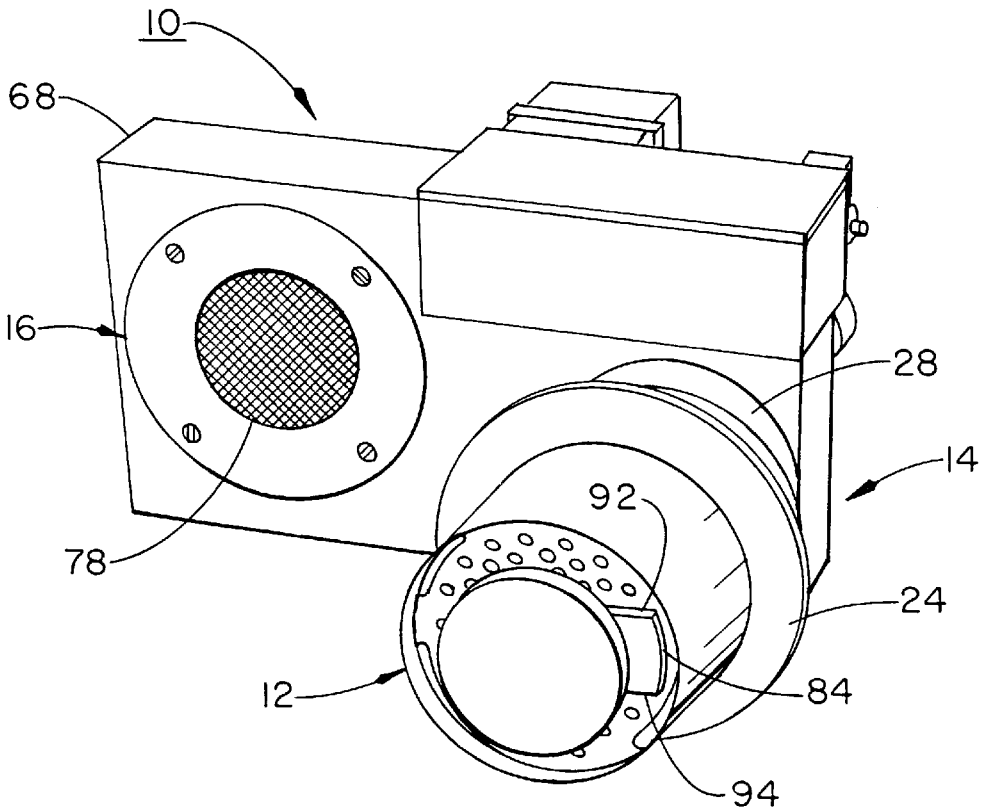
FIG. 1 is a perspective front view of a gas burner assembly constructed in accordance with the present invention.
Figure 2:
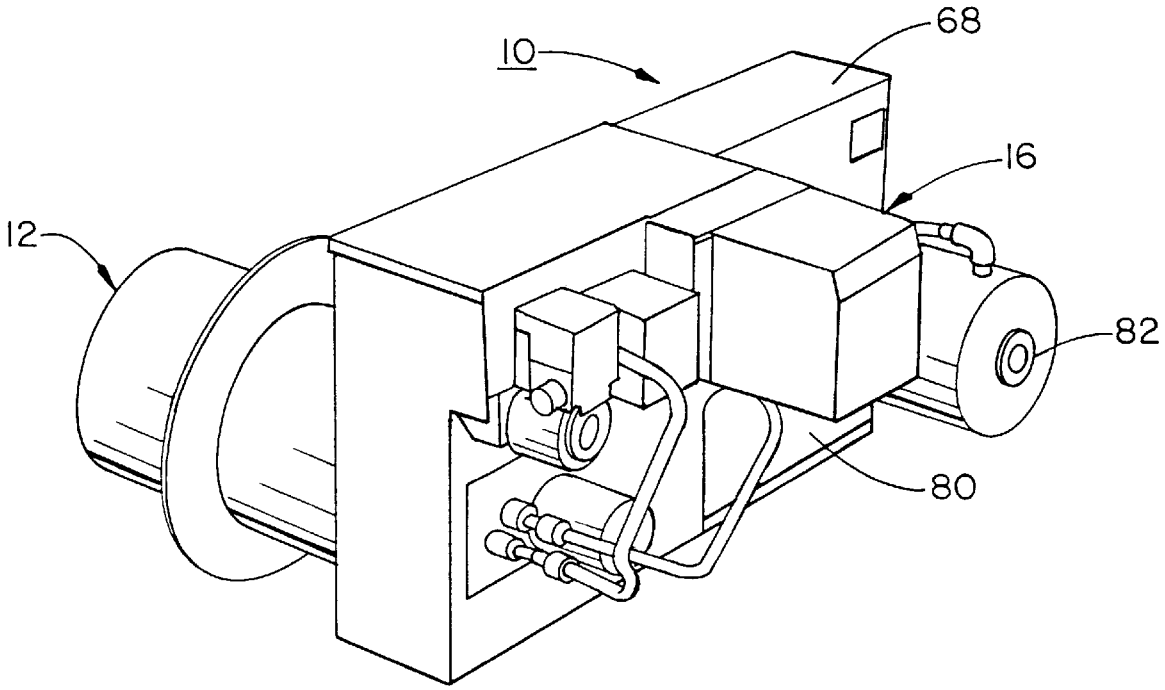
FIG. 2 is a perspective back view of the gas burner assembly of FIG. 1.

Turning now to the drawings and more particularly to FIGS. 1 and 2, shown therein are front and rear perspective views, respectively, of a burner assembly 10 constructed in accordance with a preferred embodiment of the present invention. A description of the burner assembly 10 will be provided herein sufficient for those skilled in the art to make and use, and it will be understood that many details of construction need not be included since such will be known by those skilled in art.

Figure 3:
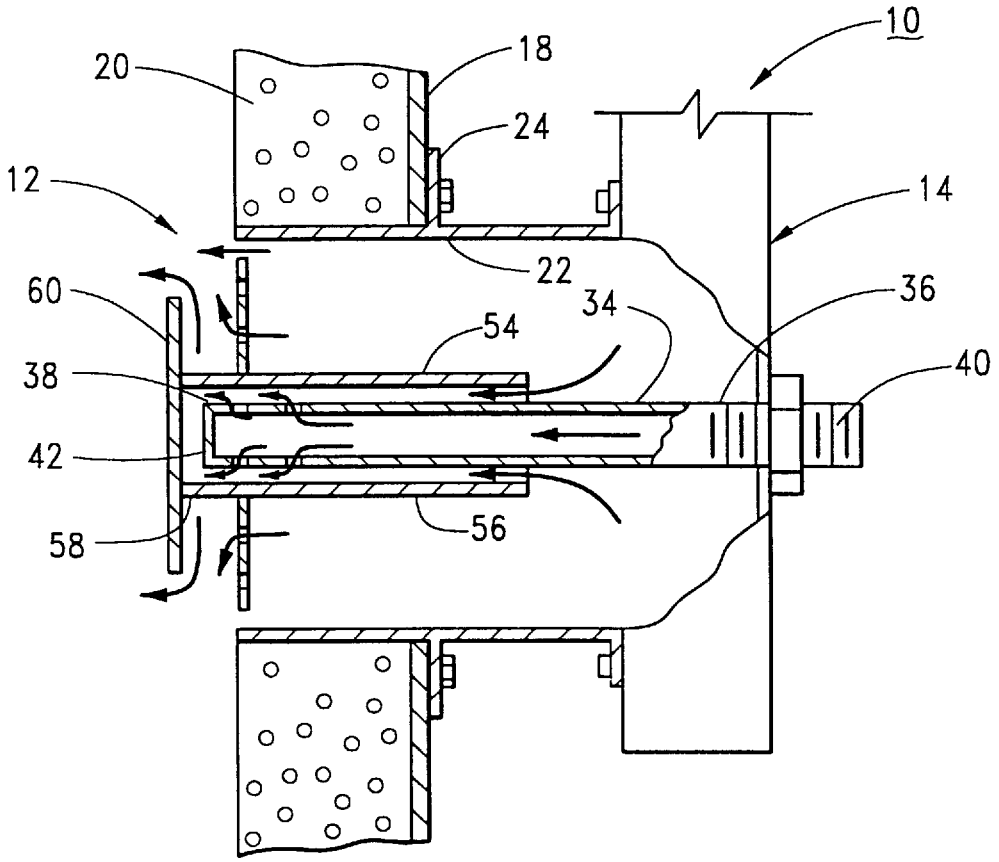
Figure 4:
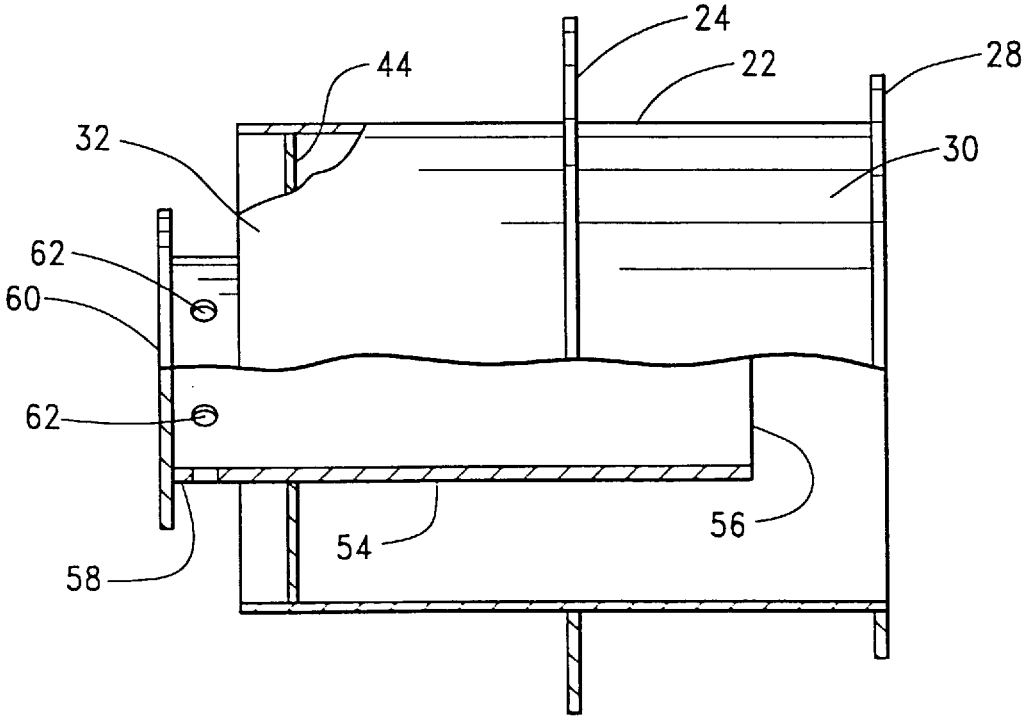
FIG. 4 shows a partial cutaway portion of the burner of gas burner assembly of FIG. 1.
Figure 5:
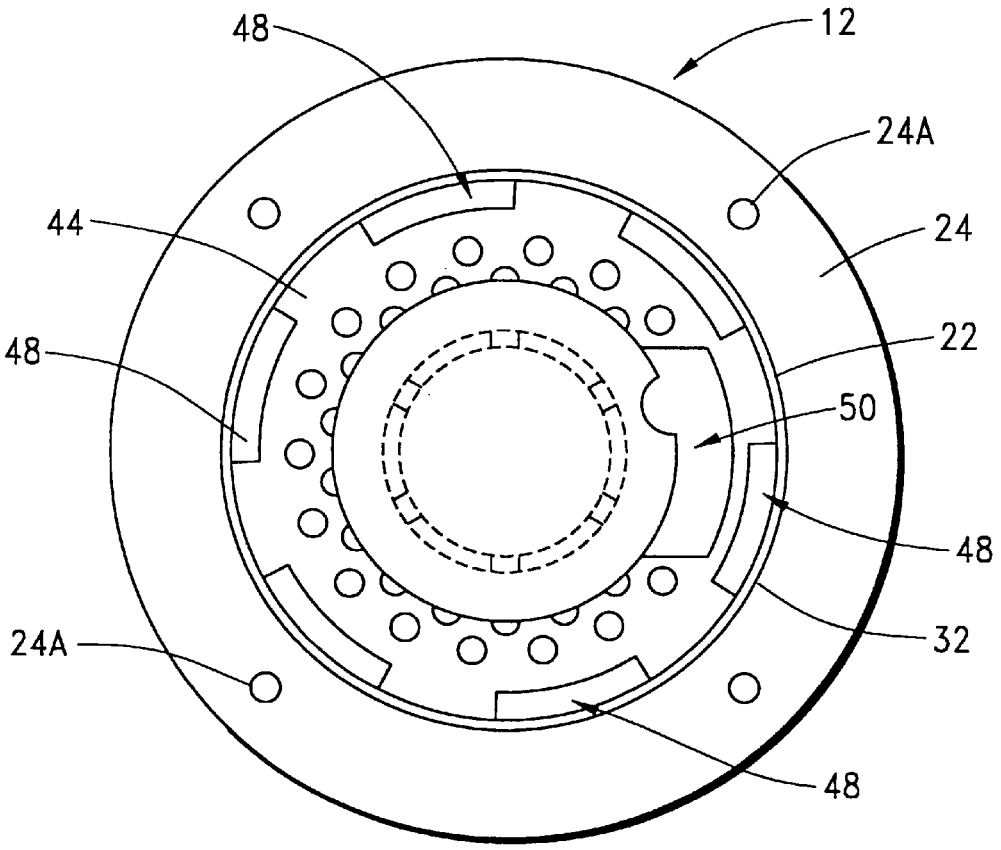
FIG. 5 shows a front view of the burner tube of FIG. 4.

The burner assembly 10 comprises a burner assembly 12 (also sometimes referred to herein as a burner head or simply as a burner), a burner housing assembly 14 and a blower assembly 16. In FIG. 3, the burner assembly 12 is shown in partial cutaway detail and installed to a boiler wall 18 in which refractory insulation 20 is provided. As also shown in FIG. 4, the burner assembly 12 comprises a hollow burner tube 22 which has an outer mounting flange 24 (see FIG. 5) with spaced apart apertures 24A through which bolts 26 extend to secure the burner assembly 12 to the boiler wall 18. Another outer mounting flange 28 is provided for bolting the burner assembly 12 to the burner housing assembly 14 in the manner shown in FIG. 1.

The burner tube 22 has an open air inlet end 30 and a gas/air outlet end 32. Extending coaxially through the burner tube 22 from the air inlet end 30 is a gas tube 34 which has a gas inlet first end 36 and a second end 38. The gas inlet first end 36 has external threads and is threadingly received in a coupling 40 which is supported by the burner housing assembly 14. The second end of the gas tube 34 is sealed with an end plate 42.

Figure 6:
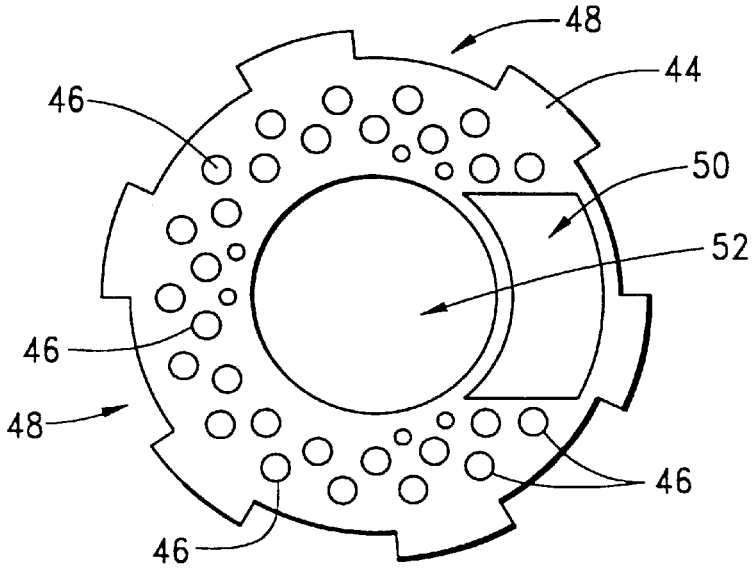
FIG. 6 is a front view of the air diffuser plate of the burner of FIG. 4.

Disposed within the burner tube 22 near the gas/air outlet end 32 is an air diffuser plate 44 (also shown in FIG. 6 by itself) which has a plurality of apertures 46. The air diffuser plate 44 is secured to the inner wall of the burner tube 22 such as by welding, and a plurality of clearance notches 48 are provided in the outer peripheral portion of the air diffuser plate 44 as shown. Also, a clearance slot 50 and a central aperture 52 are provided in the air diffuser plate 44 as shown in FIG. 6.

As shown in FIGS. 3 and 4, a hollow premixing tube 54 is coaxially disposed in the burner tube 22 and extending over the second end 38 and part of the medial portion of the gas tube 34. The outer diameter of the premixing tube 54 is established such that the premixing tube 54 extends through the central aperture 52 of the air diffuser plate 44 and is attached to the air diffuser plate 44 such as by welding so as to be supported thereby. The premixing tube 54 has a first end 56 which is in fluid communication with the burner tube 22 and a second end 58 which extends from the air diffuser plate 44 as shown. A baffle plate 60 is welded transversely to, and seals, the second end 58 of the premixing tube 54. A plurality of gas/air mixture injection holes 62 are provided in the second end 58 of the premixing tube 54 between the baffle plate 60 and the air diffuser plate 44.

Figure 7:
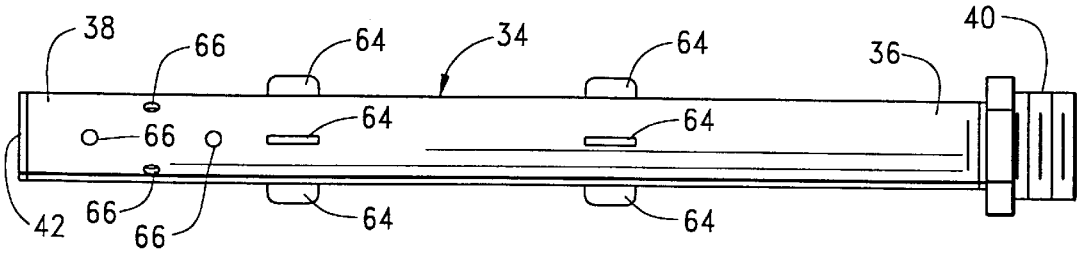
FIG. 7 is a side view of the gas tube of the burner of FIG. 3.
Figure 8:
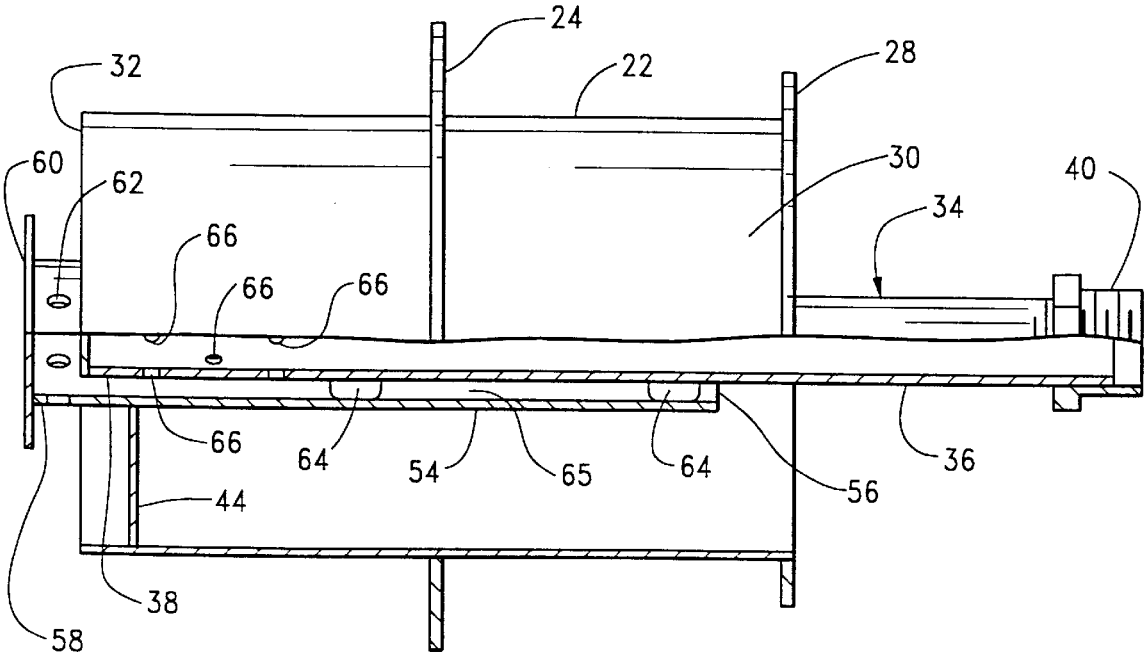
FIG. 8 is a partial cutaway side view of the burner of FIG. 4 with the inclusion of the gas tube of FIG. 8.
Figure 3:
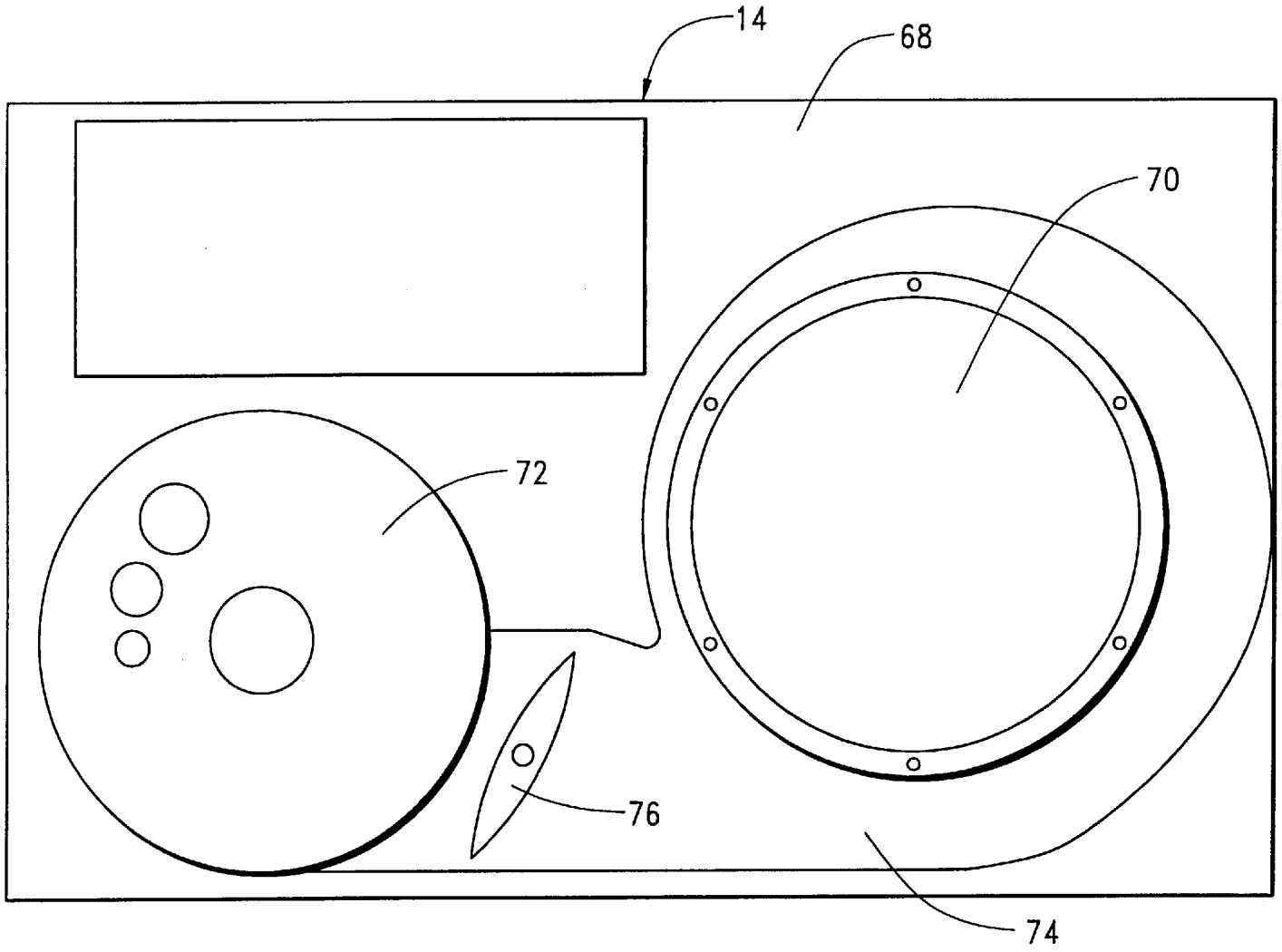

As shown in FIG. 7, the gas tube 34 has several spacer tabs 64 extending radially along its length and extending across annular passageway 65 which is formed between the gas tube 34 and the internal wall of the premixing tube 54 as shown in FIG. 8. A plurality of gas holes 66 are spatially disposed along and about the gas tube 34 in proximity to the closed second end 38 so that part of the air entering the air inlet end 30 of the burner tube 22 passes through the annular space 65 and is premixed with gas discharged from the gas holes 66 to form a gas/air mixture which is discharged from the gas/mixture injection holes 62 to pass radially between the baffle plate 60 and the air diffuser plate 44.

As depicted in FIG. 9, the burner housing assembly 14 has a housing 68 with a first housing cavity 70 and a second housing cavity 72 which are interconnected by a scroll passageway 74. An air damper 76 is pivotally disposed within the scroll passageway 74 to selectively block and thereby control the amount of air passing to the second housing cavity 72 via the scroll passageway 74. The position of the damper can be controlled by a conventional manual damper setting device (not shown), or for those applications which require a set burner output, can be secured in place via a bracket or other locking means. Further, damper articulating and characterizing mechanisms are well known in the art and which open or close the air damper 76 in response to the fuel gas fed to the gas tube 34. Electronic control circuitry for the burner assembly 10 are also well known and need not be described herein.

The blower assembly 16 (FIGS. 1 and 2) is disposed in the first cavity 70 and includes a blower (not shown) which is covered by a grille 78 bolted at the air inlet to the blower housing 68. The housing 68 has a back plate 80 which seals the first and second housing cavities 70, 72 and supports a motor 82 which drives the blower disposed in the first housing cavity 70. Several appropriately disposed clearance apertures are provided in the back plate 80 as necessary and will not be described in detail since such will not be necessary as persons skilled in the art will be familiar with such construction.

Figure 10:
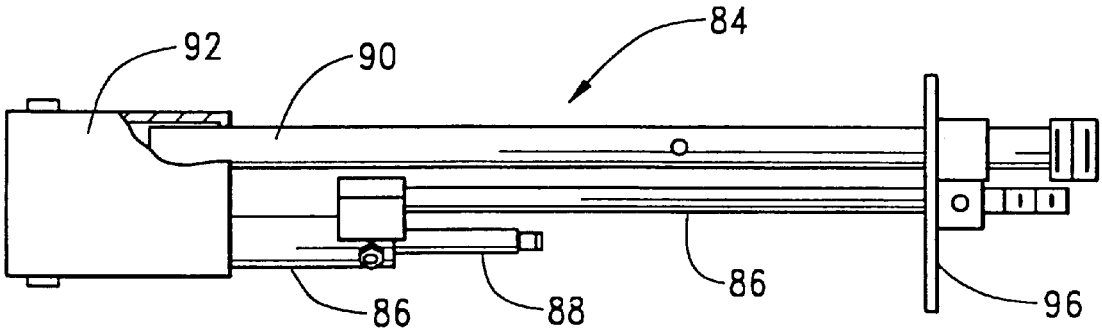
FIG. 10 is a side view of the pilot assembly of the gas burner assembly of FIG. 1.
Figure 11:
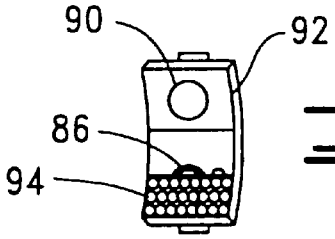
FIG. 11 is a front end view of the pilot assembly of FIG. 10.

A pilot assembly 84, shown in FIGS. 1 and 10, has a pilot gas conduit 86, an electrical igniter 88, flame detection tube 90 and a compartment box 92 in which ignition occurs. The front end of the compartment box 92, shown in FIGS. 1 and 11, has an apertured diffuser dam 94 positioned in front of the outlet end of the pilot gas conduit 86. The pilot assembly 84 extends through the burner tube 22 so that the front end of the compartment box 92 is disposed at the clearance slot 50 in the air diffuser plate 44, and in this disposition, a portion of the gas/air mixture discharged from the gas/air mixture injection holes 62 passes over the front end of the compartment box 92 and is ignited by the pilot assembly 84. The inlet ends of the pilot gas conduit 86 and the flame detection tube 90 are supported by, and extend through, a support plate 96 which is bolted to the back plate 80 at an appropriately sized aperture which permits extension of the pilot assembly therethrough. A conventional optical sensor can be connected to the rear end of the flame detection tube 90, and a conventional valving arrangement is connected to the rear end of the pilot gas conduit 86 and to the gas inlet first end 36 of the gas tube 34 via the coupling 40 which is supported by the back plate 80.

Figure 12:
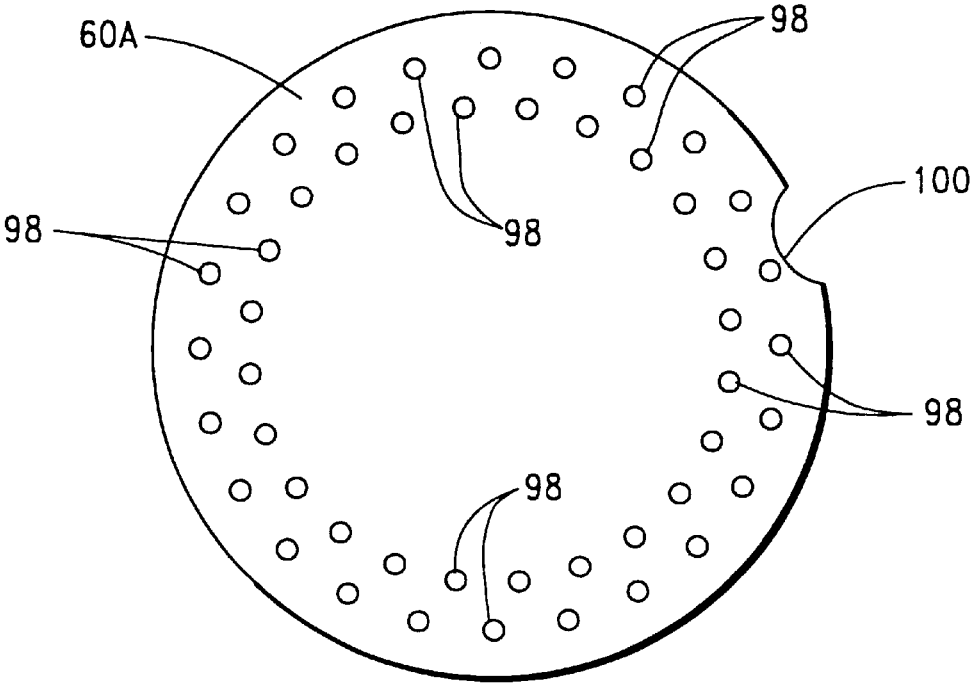
FIG. 12 is a front view of a modified baffle plate for use in the gas burner assembly of FIG. 1.

The burner assembly 10 can be modified as may be required to achieve optimum performance. For example, as shown in FIG. 12, a modified baffle plate 60A can be provided which is identical in construction detail to that of the baffle plate 60 described hereinabove with the following exception. A plurality of cooling apertures 98 are disposed around the peripheral portion and near the outer edge of the baffle plate 60A. Also, it will be noted that a clearance notch 100 is provided at one position in the outer edge portions of both the baffle plates 60A to accommodate a line of sight view of the flame through the flame detection tube 90, and the notch 100 can as well be provided in the baffle plate 60.

Figure 13:
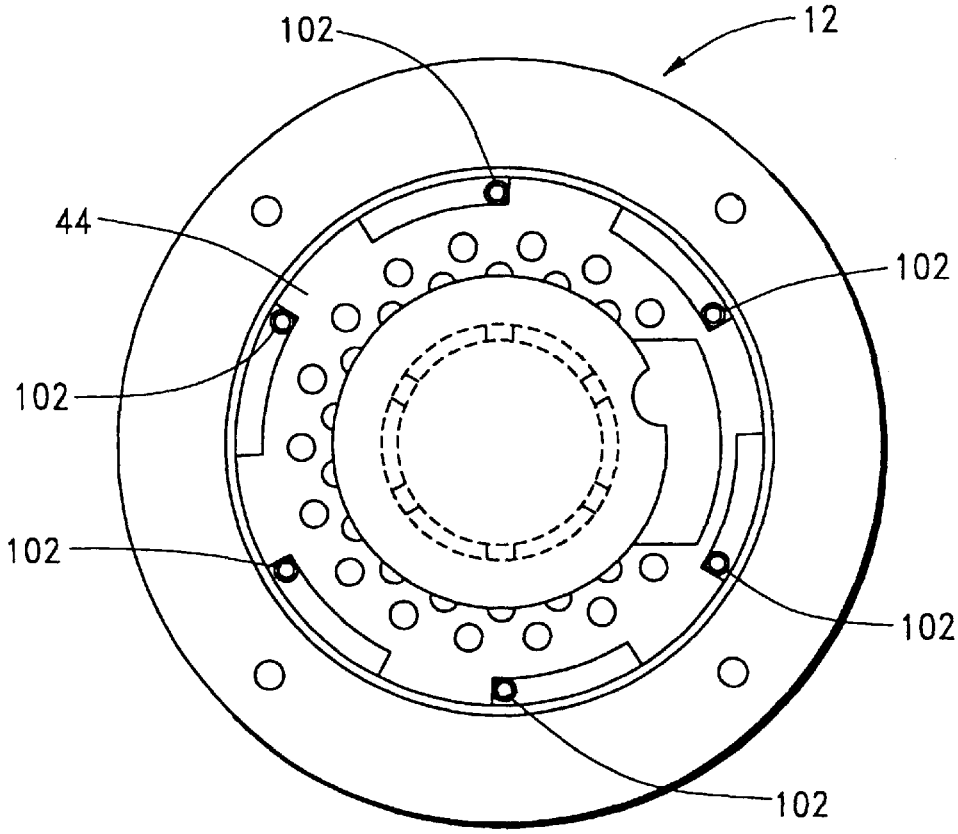
FIG. 13 is a front view of the burner tube of FIG. 5 modified to have secondary gas tubes.
Figure 14:
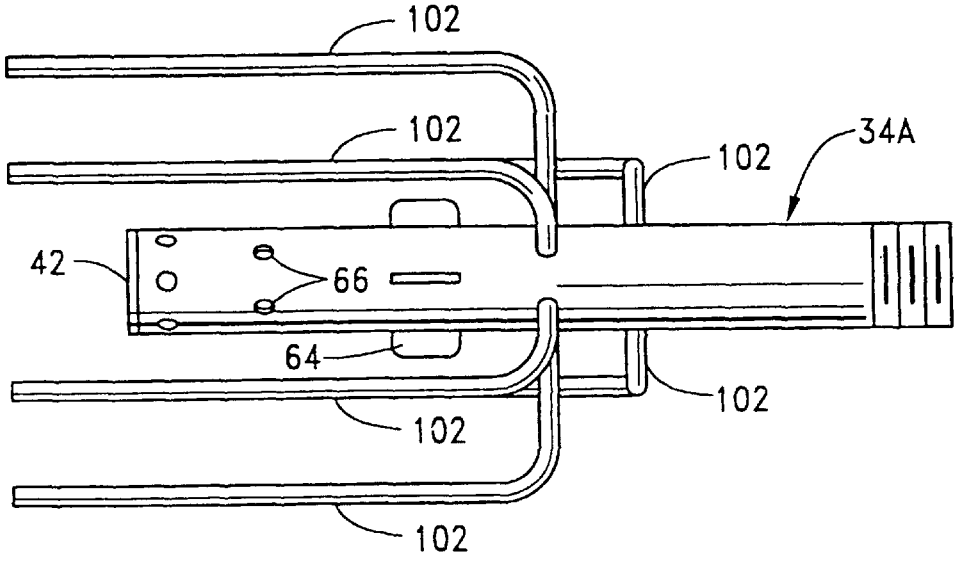
FIG. 14 is a side view of a modified gas tube showing the secondary gas tubes of FIG. 13.

Shown in FIG. 13 is the burner assembly 12 which has been outfitted with secondary fuel burner capability. That is, a plurality of secondary gas tubes 102 are provided, one each of the secondary gas tubes 102 disposed in proximity to one of the clearance notches 48 at the outer edge of the air diffuser plate 44. These secondary gas tubes 102 are part of a modified gas tube 34A which is shown in FIG. 14. The gas tube 34A is identical in construction to that of the gas tube 34 except for the provision of the secondary gas tubes 102 which are attached to and communicate with the gas tube 34A. The spatial disposition and shape of each of the secondary gas tubes 102 can be manipulated as required to have its distal end disposed at the corresponding clearance notch 48 in the air diffuser plate 44.

With regard to the spatial characteristics of the burner assembly 10, the single blade air damper 76 is installed at the blower outlet inside the housing 68 in order to reduce material requirements, to keep the air inlet opening available for possible add-ons, and to economize space. The burner housing assembly 14 discharges controlled amounts of air tangentially into the air inlet end 30 of the burner tube 22.

The modular burner tube 22 is made in such a way that different size burner heads can readily be switched. The fixed burner tube 22 has a fixed rear portion in which the scroll passageway 74 opens into to provide radially moving air from the air blower. Access plates can be provided at the back plate 80 as may be required.

The air diffuser plate 44 is installed in the burner tube 22 at its gas/air outlet end, generally being about 0.75 inches inside the burner tube 22 as measured from the front end. As shown in FIG. 6, the diffusing apertures of the air diffuser plate 44 can be of various sizes and disposed at various hole patterns as required to achieve optimum air diffusion therethrough. The radial passage of inlet air to the burner tube 22, and the relatively short premixing tube 54 (usually from about 6 to 10 inches in length) promotes air and fuel gas mixing inside the premixing tube 54. Thus, the fuel gas is premixed with the primary air before it is discharged from the premixing tube 54.

In operation, combustion air is discharged radially inside the burner tube 22, creating a cyclone effect as the air spins as it moves toward the gas/air outlet end 32 of the burner tube 22. For a given air blower wheel rotating at a fixed speed, the total amount of air being delivered depends on the net available flow area in the burner tube 22. The air diffusion apertures 46 and the clearance notches 48 in the air diffuser plate 44 along with the premixing tube 54 determine the amount of total air flow and thus the firing capacity of the burner assembly 10. The premixing tube 54 is sized to allow the maximum primary air through the annular space 65 between the gas tube 34 and the premixing tube 54, without making a flammable premixed air-fuel mixture inside the premixing tube 54. Fuel gas, being at higher pressure than the primary air inside the premixing tube 54, discharges from the gas holes 66 into the premixing tube 54, where the fuel gas readily mixes with the high velocity primary air.

The premixing tube 54 is positioned such that the baffle plate 60 is approximately 2 to 4 inches in front of the air diffuser plate 44 and such that the radially spaced gas/air mixture holes 62 in the premixing tube 54 are disposed between the baffle plate 60 and the air diffuser plate. This creates a low back pressure cavity or space bounded by the air diffuser plate 44, the baffle plate 60, and the outer surface of the premixing tube 54. This low pressure can be further reduced with the ejector action of high velocity secondary air streams flowing from the air diffuser plate 44 via the apertures 46 and the clearance slots 48. The primary air-gas mixture is forced to flow radially in this low pressure cavity out of the gas/air mixture injection holes 62 in the premixing tube 54. The balance of the air flows through the air diffuser plate 44 away from the radially flowing gas/air mixture.

Ignition occurs in front of the air diffuser plate 44, thereby igniting the out flowing primary gas/air mixture. A fraction of the gas/air mixture burns at the surface of the premixing tube 54 in front of the air diffuser plate 44 and behind the baffle plate 60, while the remainder burns in front of the diffuser apertures 46 in the air diffuser plate 44 after it meets the secondary air. Thus, flame staging is achieved; that is, a fuel-rich primary flame zone on the premixture tube 54 surface and a fuel-lean secondary flame zone on the surface of the air diffuser plate 44 in front of the diffuser apertures 46 and clearance slots 48 are formed.

Further staging can be achieved by the alignment of the air holes with respect to the air slot locations. Since the number and angular spacing of air holes in the premixing tube and the air slots in the air diffuser plate are substantially identical, the air holes can be aligned with the air slots. Alternatively, the air holes can be disposed to achieve an offset orientation; that is, the air holes can be aligned with the solid portions on the air diffuser plate between the air slots. In the first case, the flame is broken into flamelets that burn in front of the air slots. In the second case, zones of fuel-rich mixture in between the air slots and fuel-lean mixtures in front of the air slots are formed. The alignment choice depends on the pollution emission characteristics required of the burner.

Due to the rotation or spinning of the secondary air flowing from the air slots, flames appear like curving or rotating fingers of flame. This high spin improves flame stability by imparting it at a radial momentum and keeping it at or near the diffuser plate surface. Moreover, the high spin configuration also helps keep the flame intense and short in both radial as well as axial directions, thereby making the burner of the present invention suitable for many combustion chambers in which the chamber diameter or length is of restricted dimension.

The rapid mixing and air fuel staging described hereinabove (splitting of the flame into flamelets with high spin) helps eliminate or reduce CO emissions, and it reduces the amount of NOx produced. In the primary combustion zone, where fuel is in abundance, CO is formed but then is destroyed as combustion is completed in the secondary combustion zone. In the air deficient primary flame region, localized temperatures are maintained relatively low because of incomplete combustion. In the air-rich secondary flame region, a greater degree of dilution reduces the temperature. The net effect of both of these factors is a reduction in the formation of thermal NOx due to the reduced combustion temperature. Furthermore, shorter flame length also reduces the flame residence time, which in turn limits the time available for nitrogen to convert into its oxides.

The physical characteristics of the burner assembly 10—including the baffle plate diameter, alignment of air holes in the premixing tube, location of air holes behind the baffle plate, the distance between the diffuser plate and the baffle plate, and the position of the diffuser plate behind the burner front end—are important in NOx control and flame stability. Similarly, sizing of the air divider or the premixing tube is important in controlling the air-fuel stoichiometry in the two flame regions.

The constraint of not allowing the flame to move back inside the premixing tube, especially when the air and fuel flows are at their minimum, requires very fuel-rich conditions inside the premixing tube. In contrast, the desirability of having a higher portion of premixed primary flame to avoid the presence of local hot spots requires not so fuel-rich conditions inside the air tube. Thus, a trade off is necessary. The selection of the size of the baffle plate is important as this directs the primary air fuel mixture and flame toward the secondary flame zone. The size of the baffle plate also determines the extent of gaseous recirculation in its wake. If the baffle plate is too large, it will interfere with the secondary air flow and increase the back pressure seen by the gas/air delivery mechanisms. Contrarily, if the baffle plate is too small, it will not properly direct the primary fuel mixture toward the secondary flame zone. Also, flame stability will be reduced should the baffle plate be too small.

Proper positioning of the diffuser plate behind the burner front is also important as it controls the flame shape and affects flame stability. Detailed experiments using this burner have been performed in scotch marine, water tube and cast iron boilers. These experiments have shown the most desirable configuration of this burner to be as follows: (1) fuel-air ratios of approximately 1.82 and 0.67 in the primary and secondary combustion zones; (2) a diffuser plate placed in the burner head about 0.75 inch behind the end of the burner head; and (3), a baffle plate having a diameter that is about 60 to 65 percent smaller than that of the diffuser plate and positioned from about 1.25 to 1.75 inches in front of the diffuser plate, with air holes in the air tube disposed about 0.5 to 2.5 inches behind the baffle plate.

This burner geometry, in conjunction with positive combustion chamber pressure, yields as low as approximately 26 ppm NOx at selected pressures while yielding 0 ppm CO at all levels of pressure without causing any flash back or burner instability, as combustion only occurs after secondary air meets with the partially premixed gas/air mixture exiting radially from the premixing tube. In particular, the experimental results show:

8 Inch Burner Head Results:

| Combustion Chamber Pressure (inch $H_2O$) | Firing Rate (MBH) | Oxygen % | CO ppm | NOx ppm | NOx at 3% 02 PPM | Efficiency % |
|---|---|---|---|---|---|---|
| 0.1 | 2512 | 3.7 | 0 | 30 | 31.23 | 83.7 |
| 0.25 | 2506 | 3.5 | 0 | 30 | 30.87 | 83.8 |
| 0.5 | 2439 | 3.5 | 0 | 30 | 30.87 | 83.9 |
| 0.75 | 2377 | 3.5 | 0 | 30 | 30.87 | 84 |
| 1 | 2307 | 3.7 | 0 | 29 | 30.19 | 84.1 |
| 1.25 | 2246 | 3.5 | 0 | 29 | 29.84 | 84.1 |
| 1.5 | 2220 | 3.5 | 0 | 29 | 29.84 | 83.9 |

6 Inch Burner Head Results:

| Combustion Chamber Pressure (inch H20) | Firing Rate (MBH) | Oxygen % | CO ppm | NOx ppm | NOx at 3% 02 PPM | Efficiency % |
|---|---|---|---|---|---|---|
| 0.1 | 1183 | 3.5 | 0 | 30 | 30.87 | 86.1 |
| 0.25 | 1131 | 4 | 0 | 26 | 27.55 | 85.6 |
| 0.5 | 1101 | 3.5 | 0 | 26 | 26.75 | 85.6 |
| 0.75 | 1054 | 3.7 | 0 | 29 | 30.19 | 85.7 |
| 0.95 | 1050 | 3.5 | 0 | 29 | 39.84 | 81.9 |

In summary, the present invention employs the features of premixing and diffusion to create a burner which produces a homogeneous flame with reduced NOx emissions while avoiding the dangers of combustion flashback. As described hereinabove, the primary air in the present burner is partially premixed with the fuel prior to reaching the point of ignition. The partially premixed gas/air mixture is then dispersed radially out of the premixing tube at which point the premixed gas/air mixture mixes with the secondary air from the air diffuser to complete combustion. The partial premixing feature of the burner produces a homogeneous flame with reduced NOx while avoiding the dangers of flame flash back because the partially premixed gas/air mixture is not sufficient to complete combustion within the burner head.

It is clear that the present invention is well adapted to carry out the objects and to attain the ends and advantages mentioned as well as those inherent therein. While presently preferred embodiments of the invention have been described in varying detail for purposes of the disclosure, it will be understood that numerous changes may be made which will readily suggest themselves to those skilled in the art and which are encompassed within the spirit of the invention disclosed and as defined in the above text and in the accompanying drawings.

What is claimed is:

1. A burner assembly comprising:

a burner tube having an air inlet end and a gas/air outlet end;

an air diffuser plate supported in the burner tube near the gas/air outlet end and having a plurality of air diffusing openings;

a premixing tube substantially disposed within the burner tube and having a first end in fluid communication with the burner tube and a second end extending from the gas/air outlet end, the air diffuser supported between the premixing tube and the burner tube;

a baffle plate supported by and closing the second end of the premixing tube, the premixing tube having a plurality of gas/air mixture injection holes disposed between the air diffuser plate and the baffle plate; and a gas tube having a gas inlet first end and a closed second end, the gas tube extending into the premixing tube and having a plurality of gas holes disposed along the gas tube in proximity to the closed second end so that air entering the air inlet end of the burner tube is premixed with gas entering the gas inlet end of the gas tube and discharged from the gas holes to form a gas/air mixture which is discharged from the gas/air mixture injection holes radially to the baffle plate.

2. The burner assembly of claim 1 further comprising an air blower discharging air into the air inlet end.

3. The burner assembly of claim 2 further comprising:

a housing assembly supporting the air blower and the burner tube, the air blower having an air discharge end, the housing assembly forming an air passage in communication with the air discharge end and the air inlet end of the burner tube so that air flows radially into the air inlet end of the burner tube.

4. The burner assembly of claim 3, wherein the housing assembly further comprises:

an air damper disposed within the housing assembly and controlling air flow through the air passage.

5. The burner assembly of claim 4 further comprising a pilot assembly disposed to ignite the gas/air mixture at the gas/air outlet end of the burner tube.

6. The burner assembly of claim 5 further comprises:

detection means for detecting the presence of a combustion flame.

7. The burner assembly of claim 1 wherein the baffle plate has a plurality of cooling apertures.

8. The burner assembly of claim 7 wherein the baffle plate has a clearance notch to provide a line of sight path for the detection means.

9. The burner assembly of claim 1 further comprising:

secondary fuel means for discharging fuel gas about the periphery of the baffle plate.

10. The burner assembly of claim 9 wherein the air diffuser plate has a plurality of spaced apart clearance notches at the outer edge thereof, and wherein the secondary fuel means comprises a plurality of secondary gas tubes, each of which have one end communicating with the gas tube and a distal end disposed in proximity to one of the clearance notches of the outer edge of the air diffuser plate.

11. A gas burner assembly comprising:

a housing forming an air inlet opening and an air discharge opening; and a burner head supported by the housing and comprising:

a burner tube having an air inlet end and a gas/air outlet end, the air inlet end in communication with the air discharge opening;

a premixing tube substantially disposed within the burner tube and having a first end in fluid communication with the burner tube and a second end extending from the gas/air outlet end;

an air diffuser plate disposed within the burner tube near the gas/air outlet end and having a plurality of air diffusing openings, the air diffuser plate supported between the premixing tube and the burner tube;

a baffle plate supported by and sealing across one end of the premixing tube, the premixing tube having a plurality of gas/air mixture injection holes between the air diffuser plate and the baffle plate; and a gas tube having a gas discharge end, the gas tube extending into the premixing tube and having a plurality of gas holes disposed along the gas tube in proximity to the discharge end so that air entering the air inlet end of the burner tube is premixed with gas and discharged from the gas holes to form a gas/air mixture which is discharged by the gas/air mixture injection holes radially to the baffle plate and the air diffuser plate.

12. The burner assembly of claim 11 further comprising an air blower having an air discharge end for discharging air into the air inlet end of the burner tube so that air flows radially into the air inlet end of the burner tube.

13. The burner assembly of claim 11, wherein the housing assembly further comprises:

an air damper disposed within the housing assembly and controlling air flow through the air passage.

14. The burner assembly of claim 13 further comprising a pilot assembly disposed to ignite the gas/air mixture at the gas/air outlet end of the burner tube.

15. The burner assembly of claim 14 further comprising detection means for detecting the presence of a combustion flame.

16. The burner assembly of claim 11 wherein the baffle plate has a plurality of apertures.

17. The burner assembly of claim 16 wherein the baffle plate has a clearance notch to provide a line of sight path for the detection means.

18. The burner assembly of claim 11 further comprises:

secondary fuel means for discharging fuel gas about the periphery of the baffle plate.

19. The burner assembly of claim 18 wherein the air diffuser plate has a plurality of spaced apart clearance notches at the outer edge thereof, and wherein the secondary fuel means comprises a plurality of secondary gas tubes, each of which have one end communicating with the gas tube and a distal end disposed in proximity to one of the clearance notches of the outer edge of the air diffuser plate.

20. A gas burner assembly comprising:

a burner housing forming an air discharge opening;

a burner head supported by the burner housing and comprising:

a burner tube having an air inlet end and a gas/air outlet end; the air inlet end in communication with the air discharge opening of the burner housing;

a premixing tube substantially disposed within the burner tube and having a first end in fluid communication with the burner tube and a second end extending from the gas/air outlet end;

an air diffuser plate disposed within the burner tube near the gas/air outlet end and having a plurality of air diffusing openings, the air diffuser plate supported between the premixing tube and the burner tube;

a baffle plate having a plurality of apertures and being supported by and sealing one end of the premixing tube, the premixing tube having a plurality of gas/air mixture injection holes between the air diffuser plate and the baffle plate;

a gas tube having a gas discharge end, the gas tube extending into the premixing tube and having a plurality of gas holes disposed therein in proximity to the discharge end so that air entering the air inlet end of the burner tube is premixed with gas and discharged from the gas holes to form a gas/air mixture, whereby the gas/air mixture travels through the gas/air mixture injection holes of the premixing tube, the gas/air mixture radially discharging to the baffle plate and the air diffuser plate;

secondary fuel means for discharging fuel gas about the periphery of the baffle plate; and an air blower having an air discharge end, the air discharge end radially releasing the air into the air inlet end of the burner tube.

21. The burner assembly of claim 20, wherein the air diffuser plate has a plurality of spaced apart clearance notches at the outer edge thereof, and wherein the secondary fuel means comprises a plurality of secondary gas tubes, each of which have one end communicating with the gas tube and a distal end disposed in proximity to one of the clearance notches of the outer edge of the air diffuser plate.

22. The burner assembly of claim 20, wherein the burner housing further comprises:

detection means for detecting the presence of a combustion flame; and an air damper disposed within the housing and controlling air flow.

23. The burner assembly of claim 20 further comprising a pilot assembly disposed to ignite the gas/air mixture at the gas/air outlet end of the burner tube.

* * * * *